US011371283B2

(12) United States Patent
Wang

(10) Patent No.: US 11,371,283 B2
(45) Date of Patent: Jun. 28, 2022

(54) CONVENIENTLY FIXED ROLLER BLIND AND FIXING DEVICE THEREOF

(71) Applicant: SHENZHEN RUIQING XINGYE PLASTIC CO. LTD., Shenzhen (CN)

(72) Inventor: Chih-Yung Wang, Taipei (TW)

(73) Assignee: SHENZHEN RUIQING XINGYE PLASTIC CO. LTD., Shenzhen (CN)

( * ) Notice: Subject to any disclaimer, the term of this patent is extended or adjusted under 35 U.S.C. 154(b) by 0 days.

(21) Appl. No.: 17/022,506

(22) Filed: Sep. 16, 2020

(65) Prior Publication Data

US 2022/0081969 A1 Mar. 17, 2022

(51) Int. Cl.
*E06B 9/42* (2006.01)

(52) U.S. Cl.
CPC ..... *E06B 9/42* (2013.01)

(58) Field of Classification Search
CPC ... E06B 9/42; E06B 9/80; E06B 9/322; E06B 9/34; E06B 9/60; E06B 2009/801
USPC ..... 160/238
See application file for complete search history.

(56) References Cited

U.S. PATENT DOCUMENTS 8,596,594 B2 * 12/2013 Shevick ..... E06B 9/24 248/200.1
10,745,966 B2 * 8/2020 Chen ..... E06B 9/42
2015/0059992 A1 * 3/2015 Liu ..... E06B 9/56 160/313
2017/0058600 A1 * 3/2017 Mocanu ..... E06B 9/44
2018/0252033 A1 * 9/2018 Bohlen ..... E06B 9/323
2019/0316414 A1 * 10/2019 Zhang ..... E06B 9/50

FOREIGN PATENT DOCUMENTS

CA 2993964 A1 * 8/2018 ..... F16D 3/70
CN 105015308 B * 4/2017 ..... E06B 9/42
KR 20150125950 A * 11/2015 ..... E06B 9/34
TW I739526 B * 7/2020 ..... E06B 9/14

* cited by examiner

*Primary Examiner* — Beth A Stephan
(74) *Attorney, Agent, or Firm* — Muncy, Geissler, Olds & Lowe, P.C.

(57) ABSTRACT

The invention provides a conveniently fixed roller blind and a fixing device thereof. The roller blind comprises a sleeving tube, a shaft assembly, a fixing device, a retractable device, two fixing brackets, and a blind. The fixing device includes a shaft housing cover, a press buckle penetrating into the shaft housing cover, a spring retracting in the press buckle, a spring damping sleeve sleeving with the press buckle to allow the spring to expand and retract inside, a damping ring fixed on a bottom end of the spring damping sleeve, and a safety buckle shaft housing provided for the spring damping sleeve and the shaft housing cover to be sleeved into. The press buckle is moved back and forth in the spring damping sleeve by the spring, and is pressed so that the roller blind can be assembled and fixed by the fixing brackets.

13 Claims, 15 Drawing Sheets

CONVENIENTLY FIXED ROLLER BLIND AND FIXING DEVICE THEREOF

FIELD OF THE INVENTION

The invention relates to a roller blind, and more particularly to a conveniently fixed roller blind and a fixing device thereof.

BACKGROUND OF THE INVENTION

Curtains are widely used for shading or decoration in homes and offices. However, most of the curtains is opened and closed by pulling the drawstrings, which are only suitable for blinds or curtains that are opened and closed from the left and right ends, but cannot be applied to the type with a single rolling blind. Therefore, the industry has developed a roller blind 1. Please refer to FIG. 1, FIG. 2, and FIG. 3. The roller blind 1 comprises a rail 11, a tube 12, and two fixing brackets 13 respectively mounted at both sides of the rail 11. The roller blind 1 also comprises a retractable device 14 provided at a left end of the tube 12, and the retractable device 14 comprises an elastic element 141 and a fixing device 142. When the retractable device 14 is pulled, a blind fabric 16 moves and opens downward clockwise; when the retractable device 14 is pulled again, the blind fabric 16 is folded upward counterclockwise; and when the blind fabric 16 is folded, it is slowly folded through a buffer device 15 disposed at a right end of the tube 12. However, the roller blind 1 is found to have the following inconveniences during the assembly process.

Since the fixing device 142 has a fixed inelastic range, if the rail 11 and the fixing brackets 13 installed at the two ends of the rail 11 are installed above a window, whether the retractable device 14 with the elastic element 141 and the fixing device 142 provided inside is installed at the left end of the tube 12 first, or the buffer device 15 is installed at the right end of the tube 12 first, the other end of the tube 12 cannot be fixed on the fixing bracket 13 at one of the two ends of the rail 11. Therefore, referring to an assembly method shown in FIG. 2, the rail 11 is fixed above the window firstly, and one of the fixing brackets 13 is installed and fixed to one of the ends of the rail 11, and then the elastic element 141 and the fixing device 142 of the retractable device 14 and the buffer device 15 are respectively assembled at the left and right ends of the tube 12 one by one, and the other fixing bracket 13 is assembled, and then the other fixing bracket 13 is installed and fixed at the other end of the rail 11. The assembly steps of the roller blind 1 are troublesome and consume man-hours, which causes inconvenience in the assembly of the entire roller blind 1. Therefore, the existing roller blind 1 has the aforementioned drawbacks.

Therefore, how to develop a roller blind that is easy to assemble and fix is indeed an urgent issue needed to be solved by the manufacturers

SUMMARY OF THE INVENTION

A main object of the invention is to solve the drawbacks of the existing roller blind and to provide a related improvement to improve the troublesome and time-consuming assembly of the roller blind, which causes inconvenient assembly of the entire roller blind. The invention provides a conveniently fixed roller blind and a fixing device thereof. A press buckle is moved back and forth inside a spring damping sleeve by a spring, and the press buckle is pressed so that the roller blind can be assembled and fixed by a fixing bracket at a left end or a right end to make the assembly of the roller blind more convenient.

According to the foregoing object, the invention provides a conveniently fixed roller blind, which includes a sleeving tube; a shaft assembly installed in one end of the sleeving tube; a fixing device installed in another end of the sleeving tube which is opposite to the shaft assembly; a retractable device installed in the sleeving tube and located between the shaft assembly and the fixing device; two fixing brackets fixed at two sides above a window, and the two fixing brackets axially connected with a third fixing column of the shaft assembly and the fixing device respectively, wherein each of the two fixing brackets includes a fixing body installed at one of the sides above the window, and a vertical body connected to a lower portion of the fixing body, and the vertical body comprises a through hole provided for the third fixing column and one end of the fixing device to pass through and to be positioned; and a blind wrapped around an outer periphery of the sleeving tube in which the retractable device is installed. The fixing device includes: a shaft housing cover, a press buckle, a spring, a spring damping sleeve, a damping ring, and a safety buckle shaft housing. The shaft housing cover includes a cover flange with a first opening, a convex connecting portion extending from one side of the cover flange and comprising a second opening communicating with the first opening, at least two snapping portions extending from one side of the cover flange and respectively comprising an elastic snap fastener connecting to an outer periphery of the convex connecting portion, a plurality of first embedding rods spaced apart from each other and abutting on an abutting body located on an inner periphery of the convex connecting portion, and each of the plurality of first embedding rods comprising a first embedding groove. The press buckle includes a first fixing column penetrating through the shaft housing cover and inserted into the through hole to be positioned, a protruding rod extending from one end of the first fixing column and comprising a third opening and formed with a first chamber inside, and a plurality of second embedding rods spaced apart on an outer periphery of a rear section of the protruding rod, wherein a plurality of second embedding grooves for embedding with the plurality of first embedding rods are respectively formed between the plurality of second embedding rods and abut on the abutting body respectively. One end of the spring is inserted in the first chamber and disposed at a top end of the first chamber, and the spring expanding and contracting inside the first chamber. The spring damping sleeve includes an outer sleeve assembled on an end of the press buckle and comprising a fourth opening and a second chamber communicating with the fourth opening, wherein an end of the second chamber is provided for accommodating another end of the spring, and a plurality of third embedding rods are disposed on an inner periphery of the second chamber at intervals for embedding with the plurality of second embedding grooves, and a plurality of third embedding grooves are respectively formed between the plurality of third embedding rods for embedding with the plurality of second embedding rods, and an convex abutting portion extends from an end of the outer sleeve, and a second fixing column is adjacent to the convex abutting portion and extends toward an opposite direction from the end of the outer sleeve. The damping ring is fixed on an outer periphery of the convex abutting portion and abuts on the end of the outer sleeve, and the damping ring forming a seal with an inner bottom end of a safety buckle shaft housing. The safety buckle shaft housing includes a convex stopper assembled on one end of the spring damping sleeve and comprising a fifth opening, and an outer shaft sleeve extending from one end of the convex stopper, wherein the convex stopper is formed with a third chamber from the fifth opening and sleeving with the cover flange, a first abutting portion formed from a bottom end of the third chamber for the cover flange to abut, and a plurality of snapping grooves arranged at intervals are formed on the first abutting portion to engage with the snapping portions, and wherein the outer shaft sleeve comprises a fourth chamber, a second abutting portion formed from an end of the fourth chamber, and a sixth opening extends from an end of the second abutting portion, and wherein the fourth chamber communicates with the fifth opening, and the convex connecting portion is placed in the fourth chamber to allow the snapping portions and the snapping grooves to be engaged with each other, and to allow the cover flange being embedded in the third chamber and abutting against the first abutting portion, and the damping ring abuts between the second abutting portion and one end of the outer sleeve to form a tight state, and the sixth opening is provided for the convex abutting portion and the second fixing column to pass through, and the press buckle is moved back and forth inside the second chamber by the spring, and the press buckle is pressed to allow the roller blind to be assembled and fixed by the two fixing brackets.

Further, the first embedding grooves communicate with the second opening respectively, and an inner diameter of the second opening is larger than an inner diameter of the first opening.

Further, the first fixing column is a square column, and the first fixing column and a front section of the protruding rod penetrate through the second opening to reach the first opening, and the third fixing column is a square column, and the through holes of the two fixing brackets are square holes in accordance with shapes of the first fixing column and the third fixing column.

Further, an end of the second chamber of the outer sleeve is provided with a protruding portion and a ring groove located on an outer periphery of the protruding portion, and another end of the spring is accommodated in the ring groove and fixed on the outer periphery of the protruding portion, and the second fixing column is provided with a second perforation for a fixing member to insert into.

Further, an outer diameter of the outer sleeve is smaller than an outer diameter of the convex stopper, an inner diameter of the fourth chamber is smaller than an inner diameter of the third chamber, and an inner diameter of the second abutting portion is smaller than an inner diameter of the fourth chamber.

Further, a first perforation is provided on an outer periphery of a front section of the protruding rod, and the fixing device further includes a safety pin which includes an elastic portion retracted and inserted into the first perforation and then resiled, a retractable portion which is elastic and is bent from a top end of the elastic portion and positioned, and a fixing ring located at another end of the elastic portion, and the retractable portion is bent in a triangular shape and comprises an end capable of retractably inserting into a hollow portion at the top end of the elastic portion to be positioned, and a width between a top and a bottom of the triangular shape of the retractable portion is larger than an outer diameter of the elastic portion, and the fixing ring is provided for a pull ring to pass through and to be fixed.

Further, the fixing body of each of the two fixing brackets is provided with a perpendicular member which comprises a plurality of fixing holes on a horizontal portion and a longitudinal portion thereof, and the perpendicular member is bent inwardly at a bottom end of the longitudinal portion, and the vertical body is provided with a connecting portion connected to the bottom end of the longitudinal portion of the perpendicular member, and a guiding portion extending downward from a bottom of the connecting portion, and the guiding portion is recessed with two grooves on both sides near a bottom respectively to allow the roller blind being temporarily placed, and the guiding portion is provided with a through hole between the two grooves, and the through hole is provided for the first fixing column and the third fixing column to pass through and to be positioned, and the guiding portion is provided with a guiding groove bent outwardly at the bottom thereof to allow the first fixing column and the third fixing column being guided from the guiding groove into the through hole for positioning.

Furthermore, a fixing device of the invention includes: a shaft housing cover, a press buckle, a spring, a spring damping sleeve, a damping ring, and a safety buckle shaft housing. The shaft housing cover includes a cover flange with a first opening, a convex connecting portion extending from one side of the cover flange and comprising a second opening communicating with the first opening, at least two snapping portions extending from one side of the cover flange and respectively comprising an elastic snap fastener connecting to an outer periphery of the convex connecting portion, a plurality of first embedding rods spaced apart from each other and abutting on an abutting body located on an inner periphery of the convex connecting portion, and each of the plurality of first embedding rods comprising a first embedding groove. The press buckle includes a first fixing column penetrating through the shaft housing cover, a protruding rod extending from one end of the first fixing column and comprising a third opening and formed with a first chamber inside, and a plurality of second embedding rods spaced apart on an outer periphery of a rear section of the protruding rod, wherein a plurality of second embedding grooves for embedding with the plurality of first embedding rods are respectively formed between the plurality of second embedding rods and abut on the abutting body respectively. One end of the spring is inserted in the first chamber and disposed at a top end of the first chamber, and the spring expanding and contracting inside the first chamber. The spring damping sleeve includes an outer sleeve assembled on an end of the press buckle and comprising a fourth opening and a second chamber communicating with the fourth opening, wherein an end of the second chamber is provided for accommodating another end of the spring, and a plurality of third embedding rods are disposed on an inner periphery of the second chamber at intervals for embedding with the plurality of second embedding grooves, and a plurality of third embedding grooves are respectively formed between the plurality of third embedding rods for embedding with the plurality of second embedding rods, and an convex abutting portion extends from an end of the outer sleeve, and a second fixing column is adjacent to the convex abutting portion and extends toward an opposite direction from the end of the outer sleeve. The damping ring is fixed on an outer periphery of the convex abutting portion and abuts on the end of the outer sleeve, and the damping ring forming a seal with an inner bottom end of a safety buckle shaft housing. The safety buckle shaft housing includes a convex stopper assembled on one end of the spring damping sleeve and comprising a fifth opening, and an outer shaft sleeve extending from one end of the convex stopper, wherein the convex stopper is formed with a third chamber from the fifth opening and sleeving with the cover flange, a first abutting portion formed from a bottom end of the third chamber for the cover flange to abut, and a plurality of snapping grooves arranged at intervals and formed on the first abutting portion to engaged with the snapping portions, and wherein the outer shaft sleeve comprises a fourth chamber, a second abutting portion formed from an end of the fourth chamber, and a sixth opening extends from an end of the second abutting portion, and wherein the fourth chamber communicates with the fifth opening, and the convex connecting portion is placed in the fourth chamber to allow the snapping portions and the snapping grooves being engaged with each other, and to allow the cover flange being embedded in the third chamber and abutting against the first abutting portion, and the damping ring abuts between the second abutting portion and one end of the outer sleeve to form a tight state, and the sixth opening is provided for the convex abutting portion and the second fixing column to pass through.

Further, the first embedding grooves communicate with the second opening respectively, and an inner diameter of the second opening is larger than an inner diameter of the first opening.

Further, the first fixing column is a square column, and the first fixing column and a front section of the protruding rod penetrate through the second opening to reach the first opening.

Further, an end of the second chamber of the outer sleeve is provided with a protruding portion and a ring groove located on an outer periphery of the protruding portion, and another end of the spring is accommodated in the ring groove and fixed on the outer periphery of the protruding portion, and the second fixing column is provided with a second perforation for a fixing member to insert into.

Further, an outer diameter of the outer sleeve is smaller than an outer diameter of the convex stopper, an inner diameter of the fourth chamber is smaller than an inner diameter of the third chamber, and an inner diameter of the second abutting portion is smaller than an inner diameter of the fourth chamber.

Further, a first perforation is provided on an outer periphery of a front section of the protruding rod, and the fixing device further includes a safety pin which includes an elastic portion retracted and inserted into the first perforation and then resiled, a retractable portion which is elastic and is bent from a top end of the elastic portion and positioned, and a fixing ring located at another end of the elastic portion, and the retractable portion is bent in a triangular shape and comprises an end capable of retractably inserting into a hollow portion at the top end of the elastic portion to be positioned, and a width between a top and a bottom of the triangular shape of the retractable portion is larger than an outer diameter of the elastic portion, and the fixing ring is provided for a pull ring to pass through and to be fixed.

Comparing with the prior art, the roller blind of the invention has the following features: the press buckle is moved back and forth in the second chamber by the spring, and the press buckle is pressed so that the roller blind is assembled and fixed by the fixing brackets, so as to the roller blind can be assembled conveniently.

DETAILED DESCRIPTION OF THE PREFERRED EMBODIMENTS

The detailed description and technical content of the invention are described below with reference to the drawings.

Figure 1:
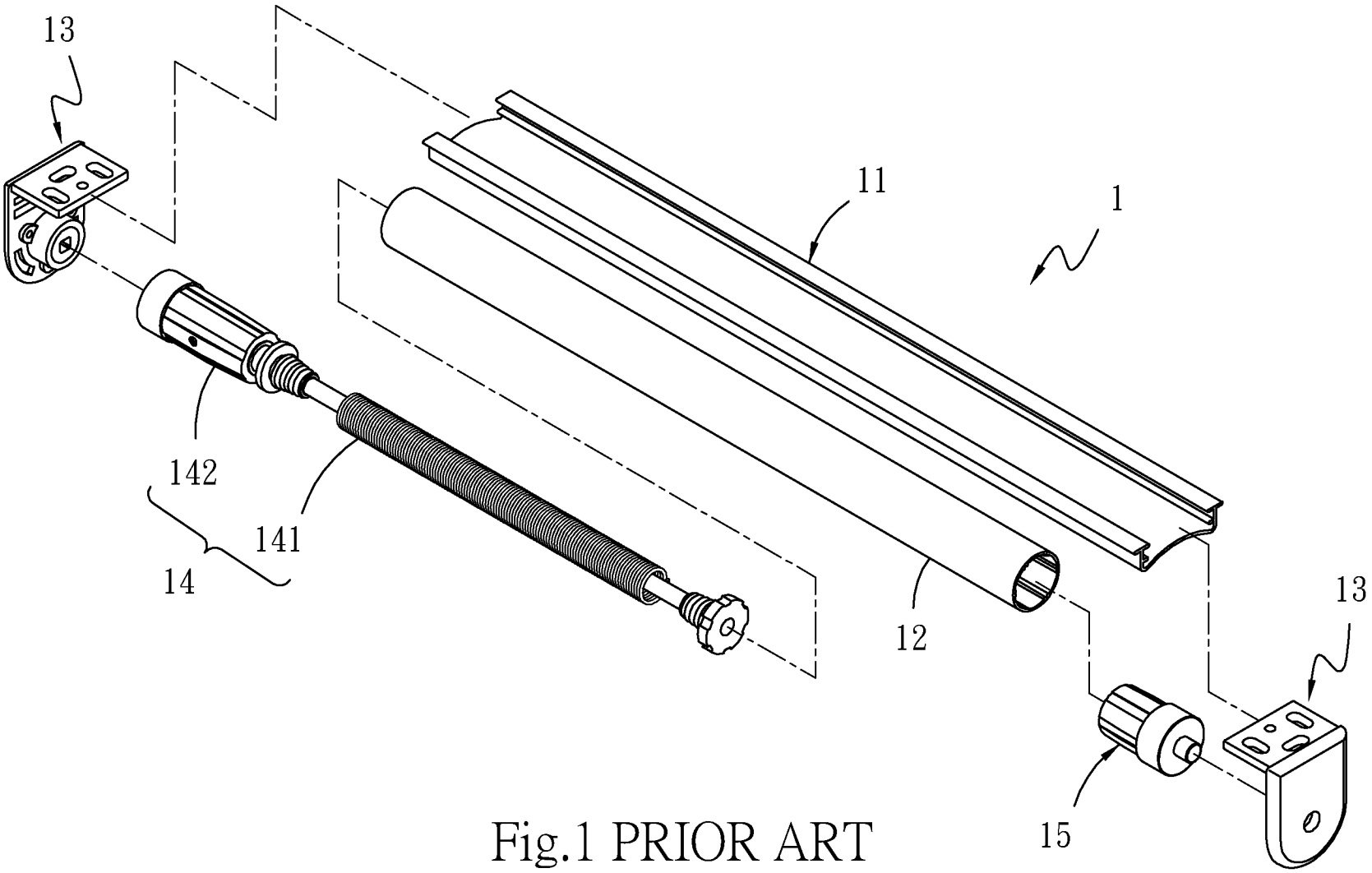
Fig.1 PRIOR ART
FIG. 1 is a perspective exploded view of an existing roller blind.
Figure 2:
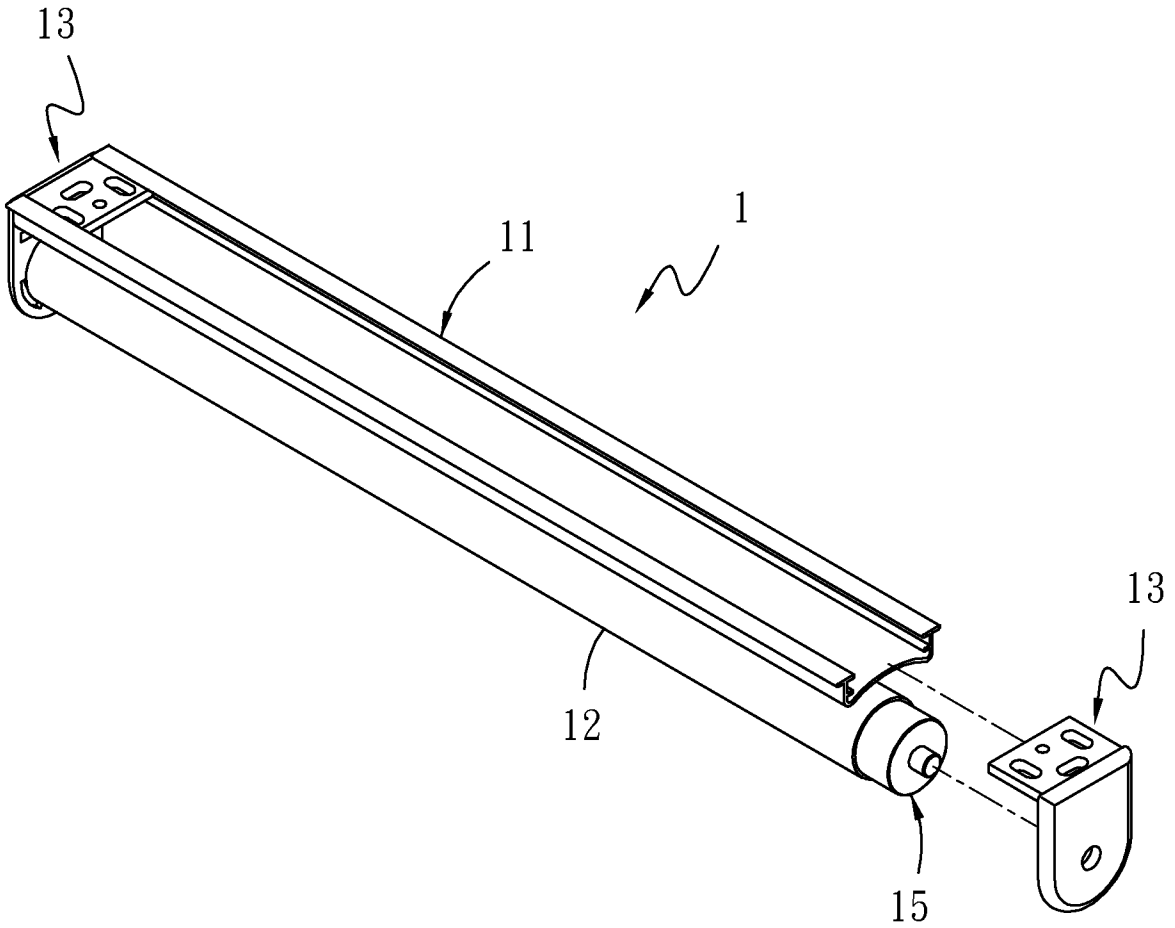
Fig.2 PRIOR ART
FIG. 2 is a perspective exploded view of the roller blind of FIG. 1 before assembly.
Figure 3:
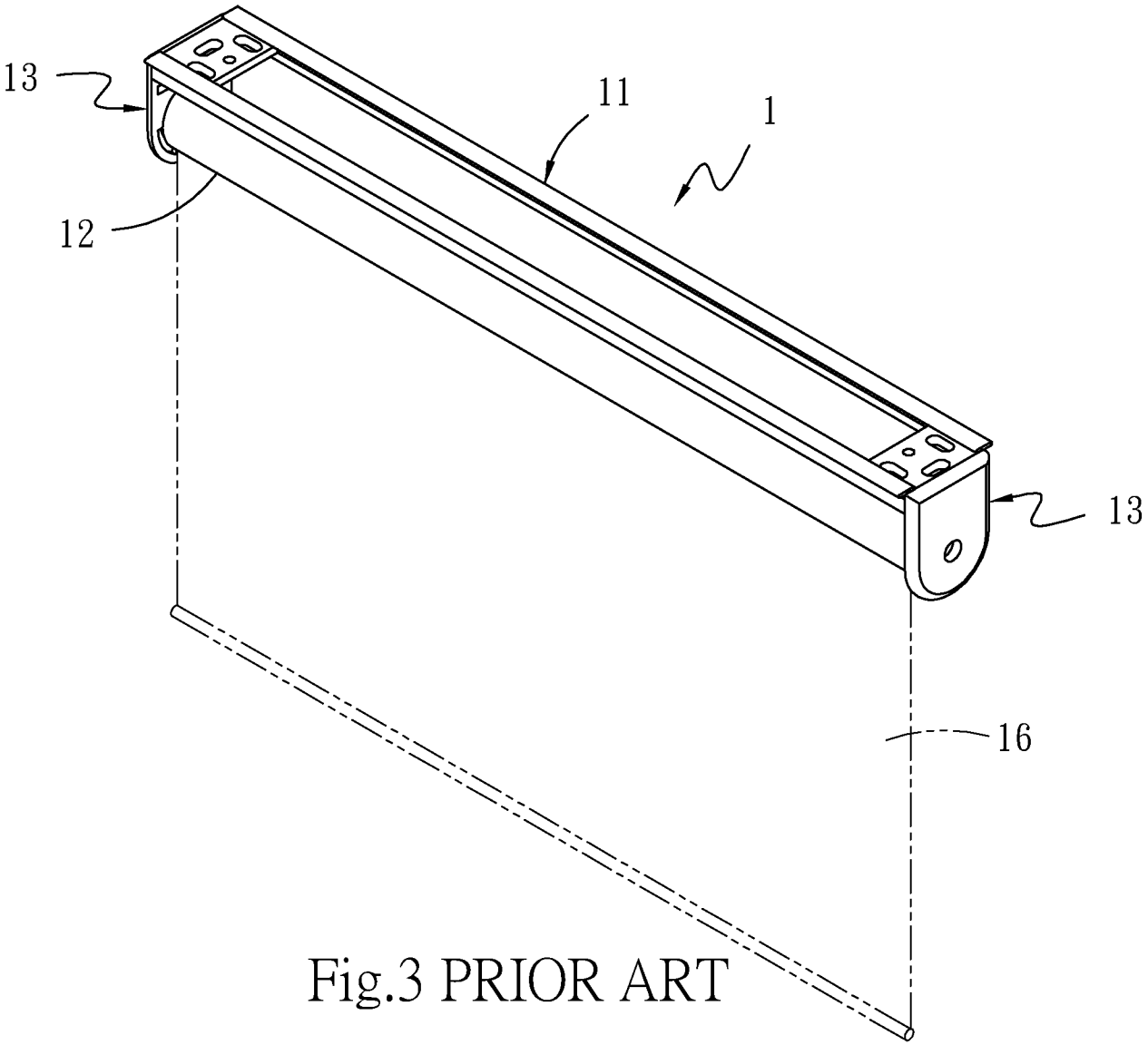
Fig.3 PRIOR ART
FIG. 3 is a perspective view of the roller blind of FIG. 1 after assembly.
Figure 4:
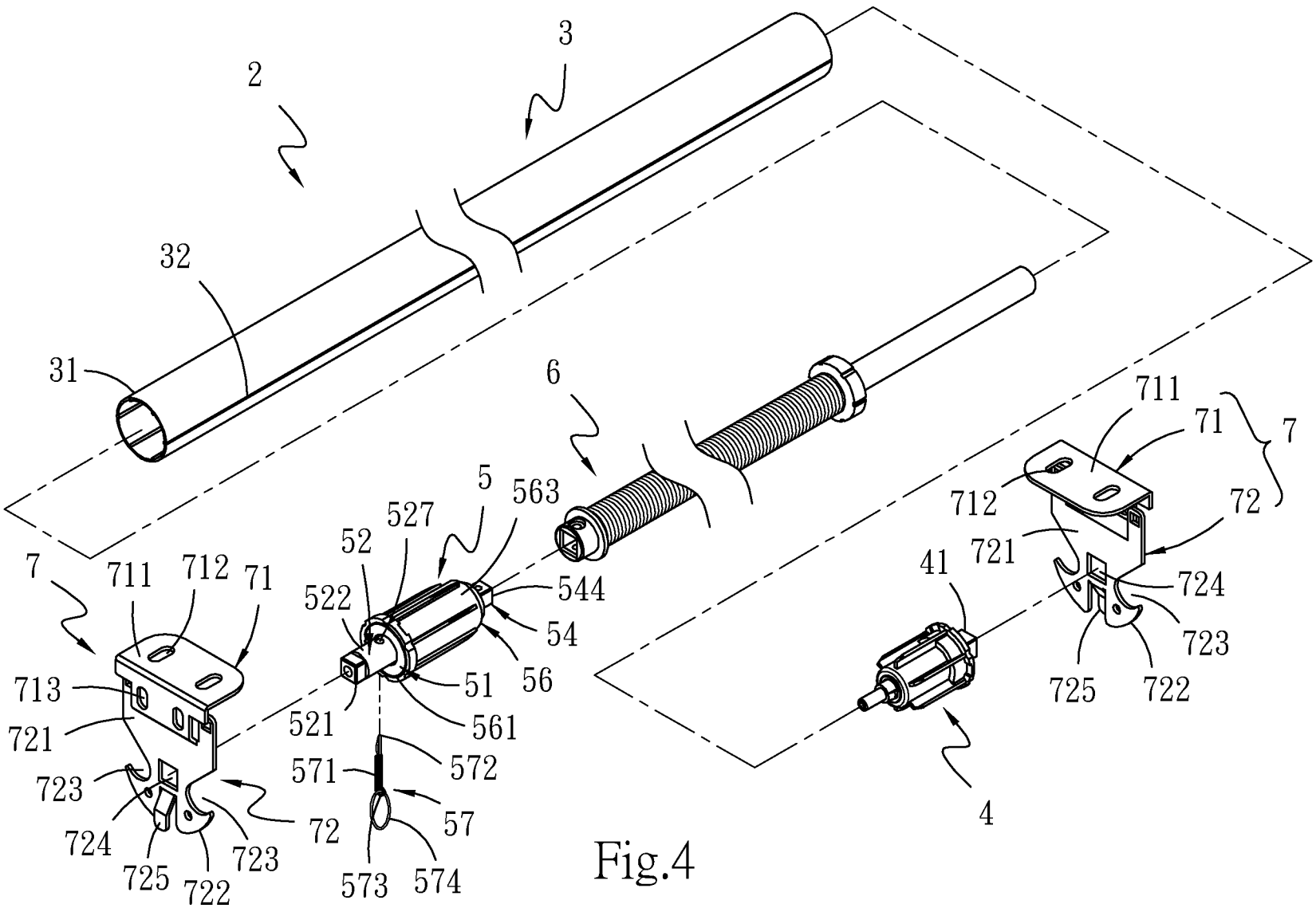
FIG. 4 is a perspective exploded view of a roller blind of the invention.
Figure 5:
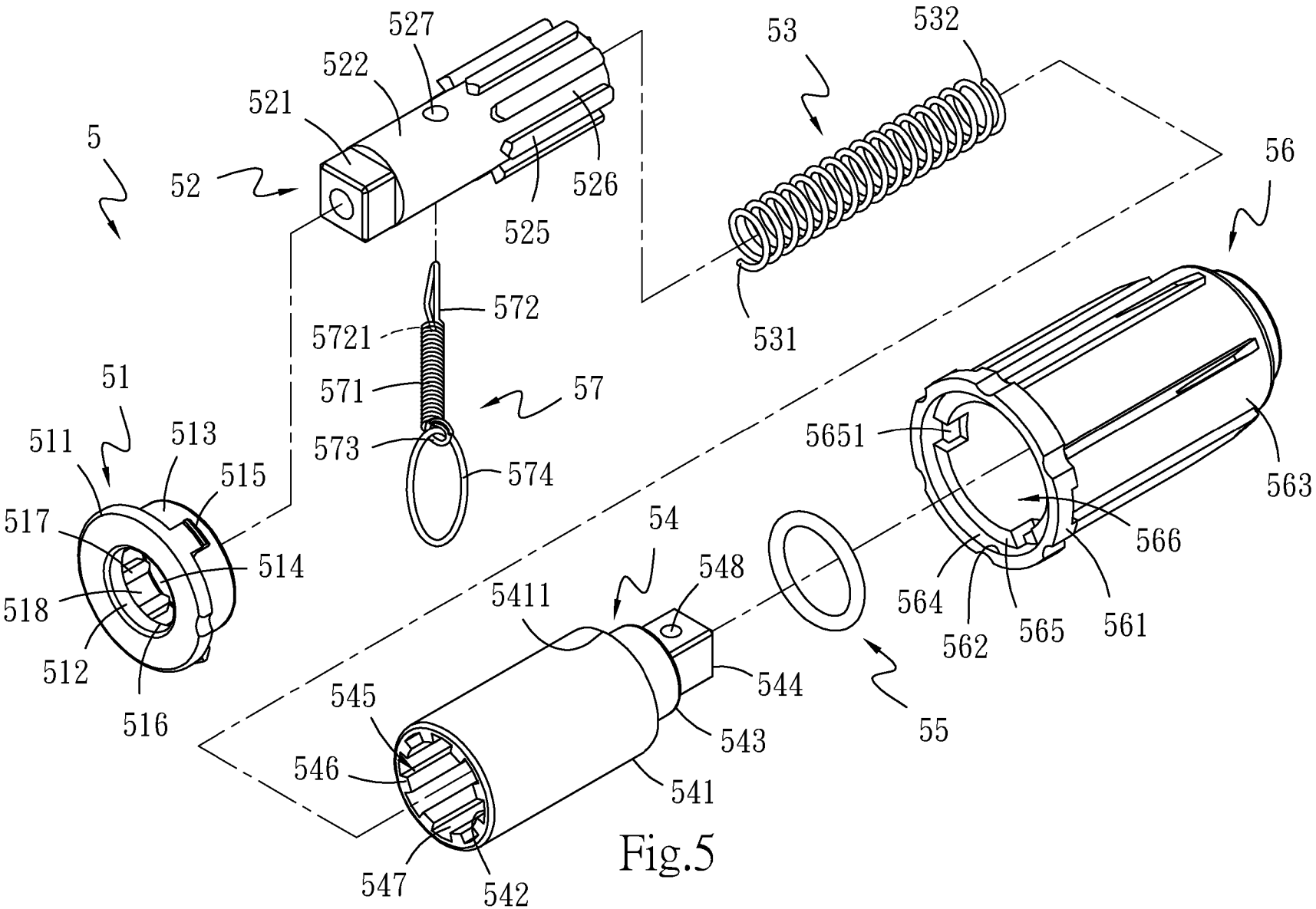
FIG. 5 is a perspective exploded view of a fixing device of FIG. 4.
Figure 6:
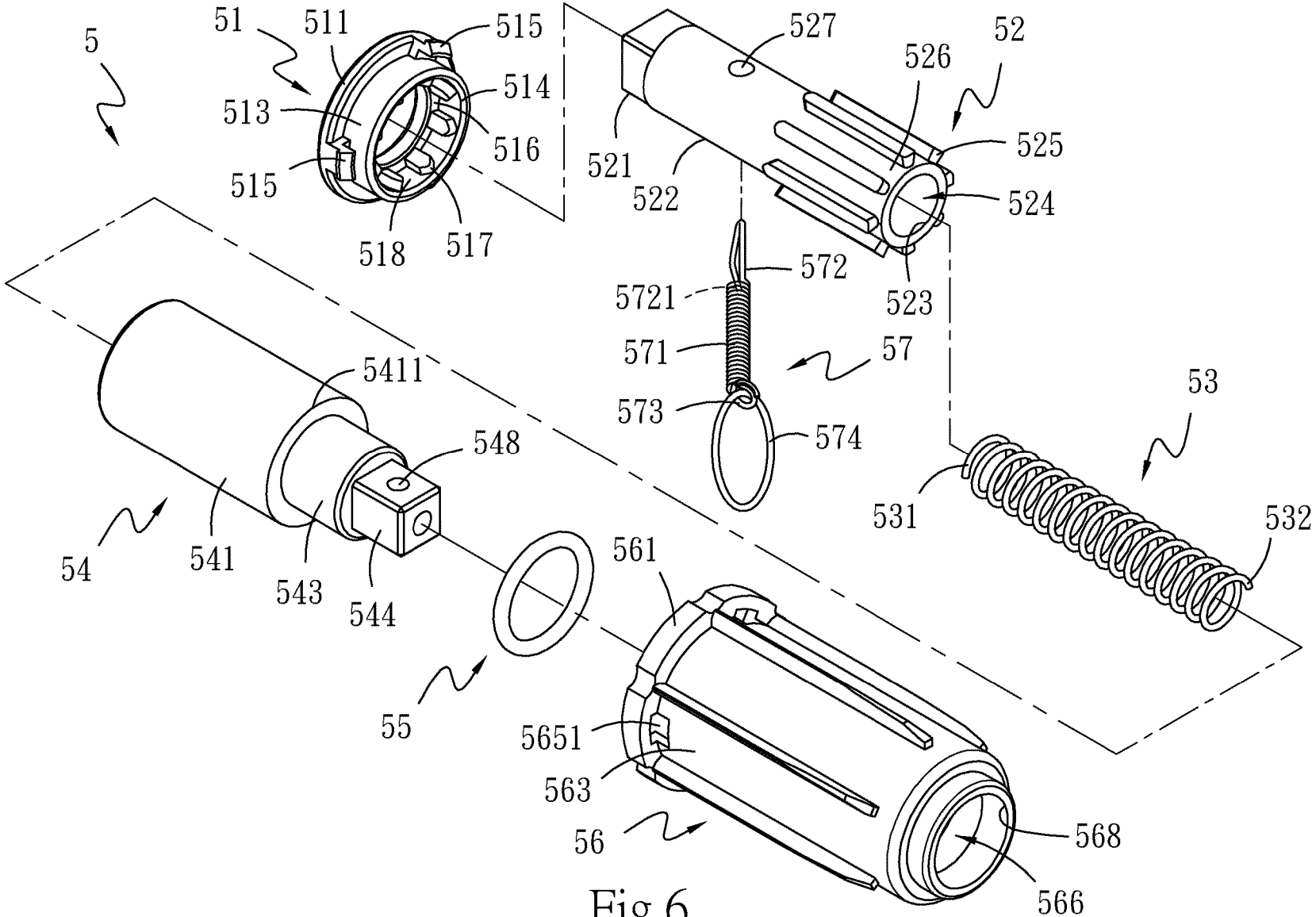
FIG. 6 is a perspective exploded view of the fixing device of FIG. 5 viewed from another angle.
Figure 7A:
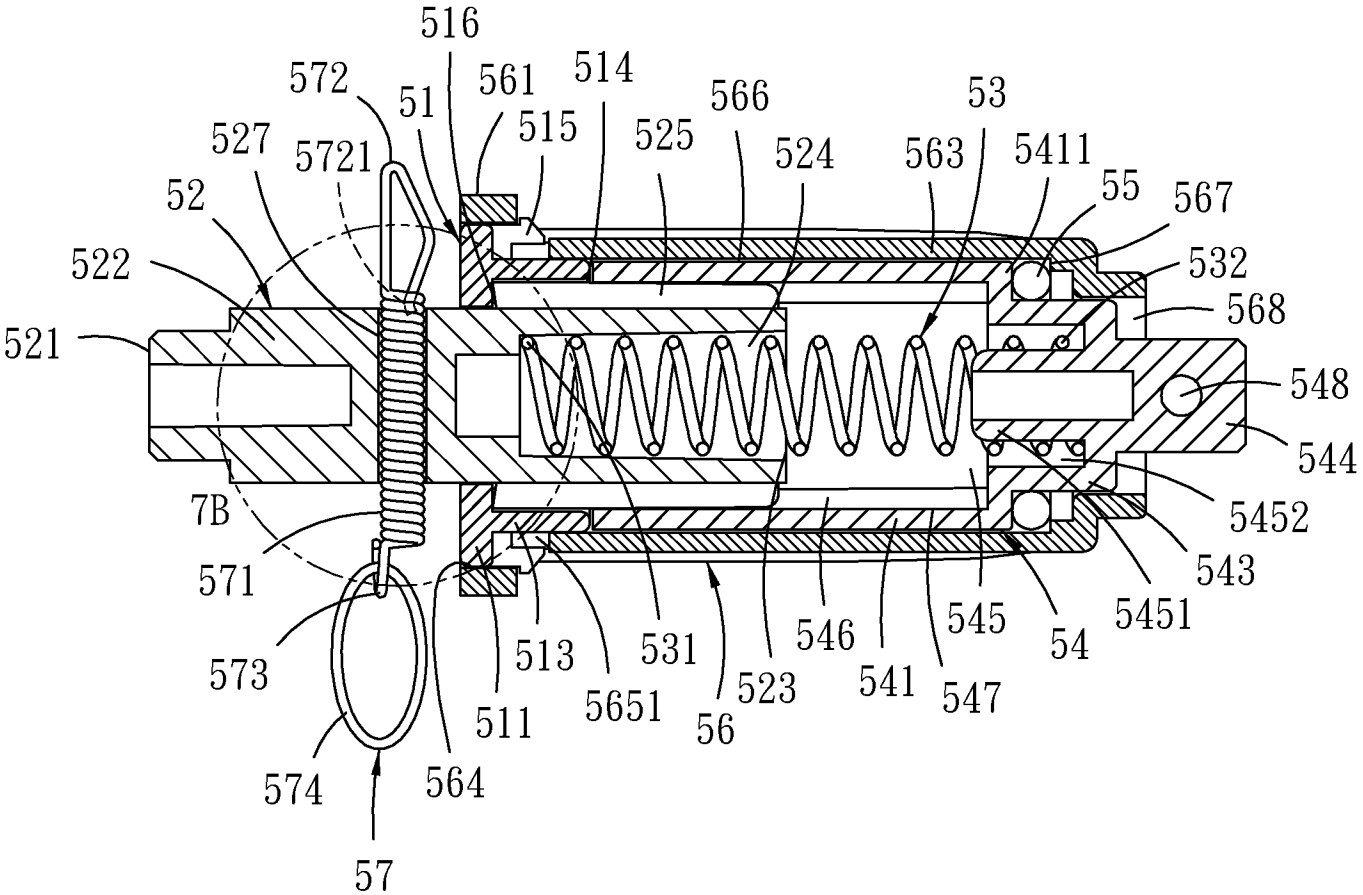
FIG. 7A is a combinational cross-sectional view of the fixing device of FIG. 6.
Figure 7B:
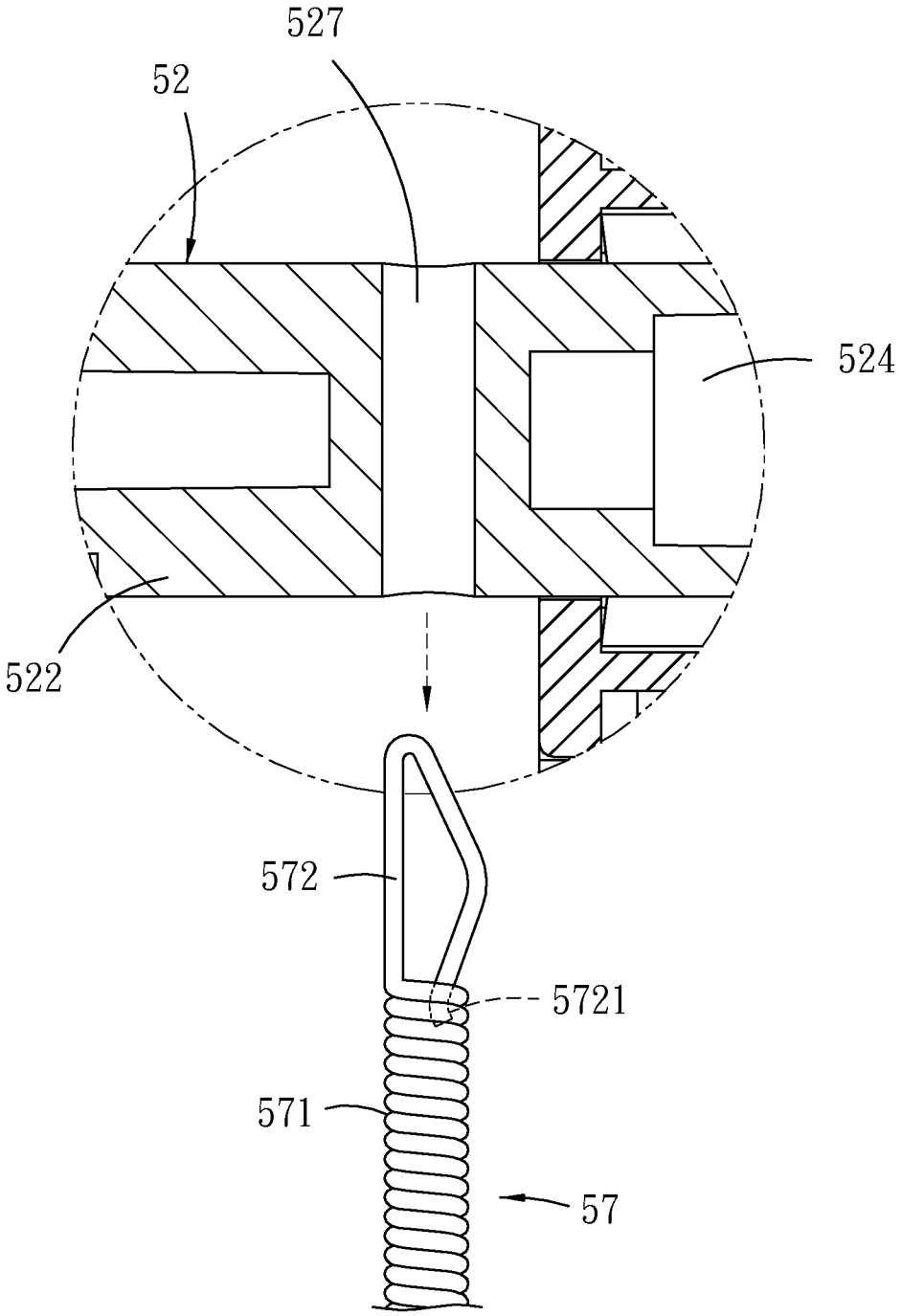
FIG. 7B is an enlarged schematic diagram of FIG. 7A at position 7B and showing a safety pin moving outward.
Figure 8A:
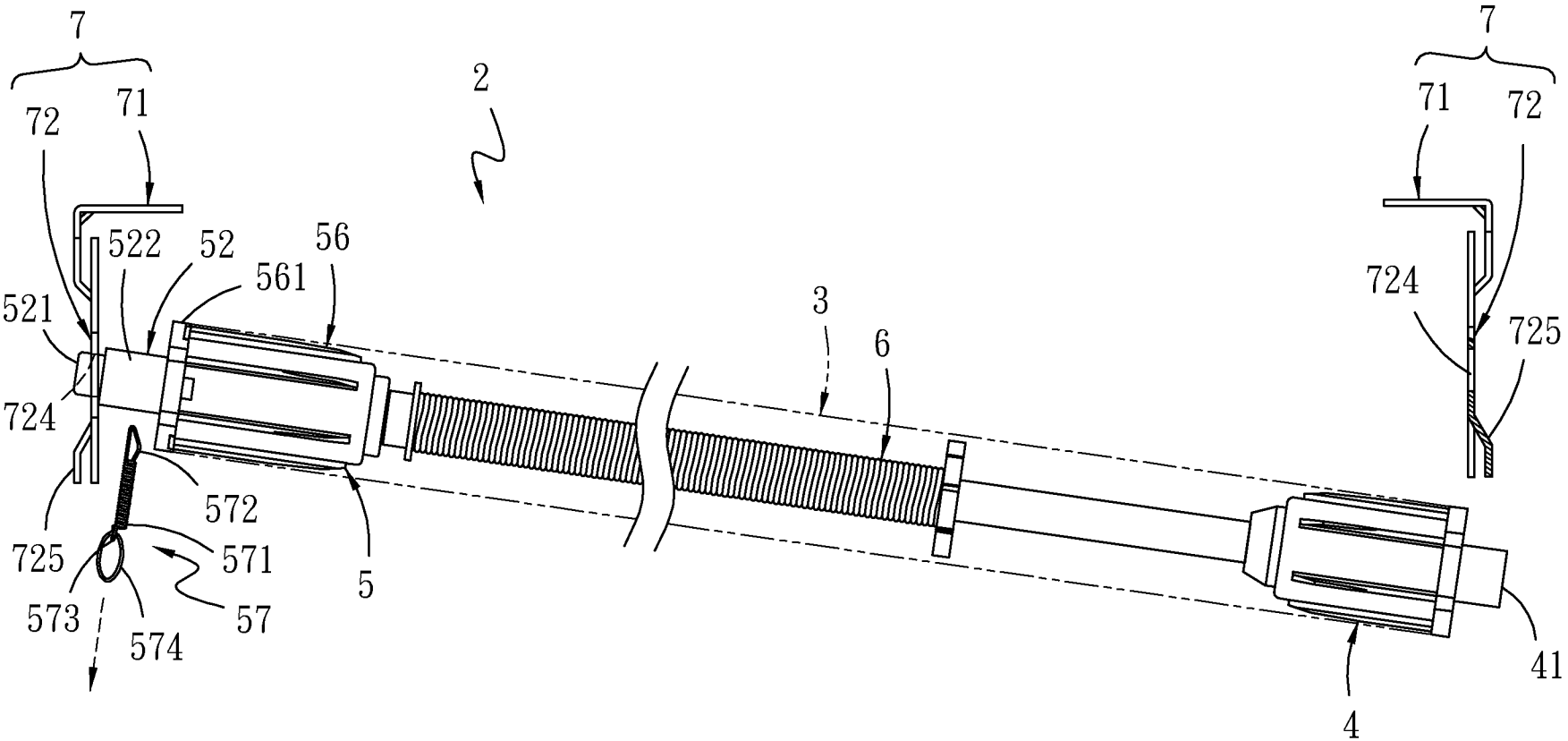
FIG. 8A is a schematic diagram of FIG. 4 firstly disposing the fixing device and moving the safety pin outward.
Figure 11:
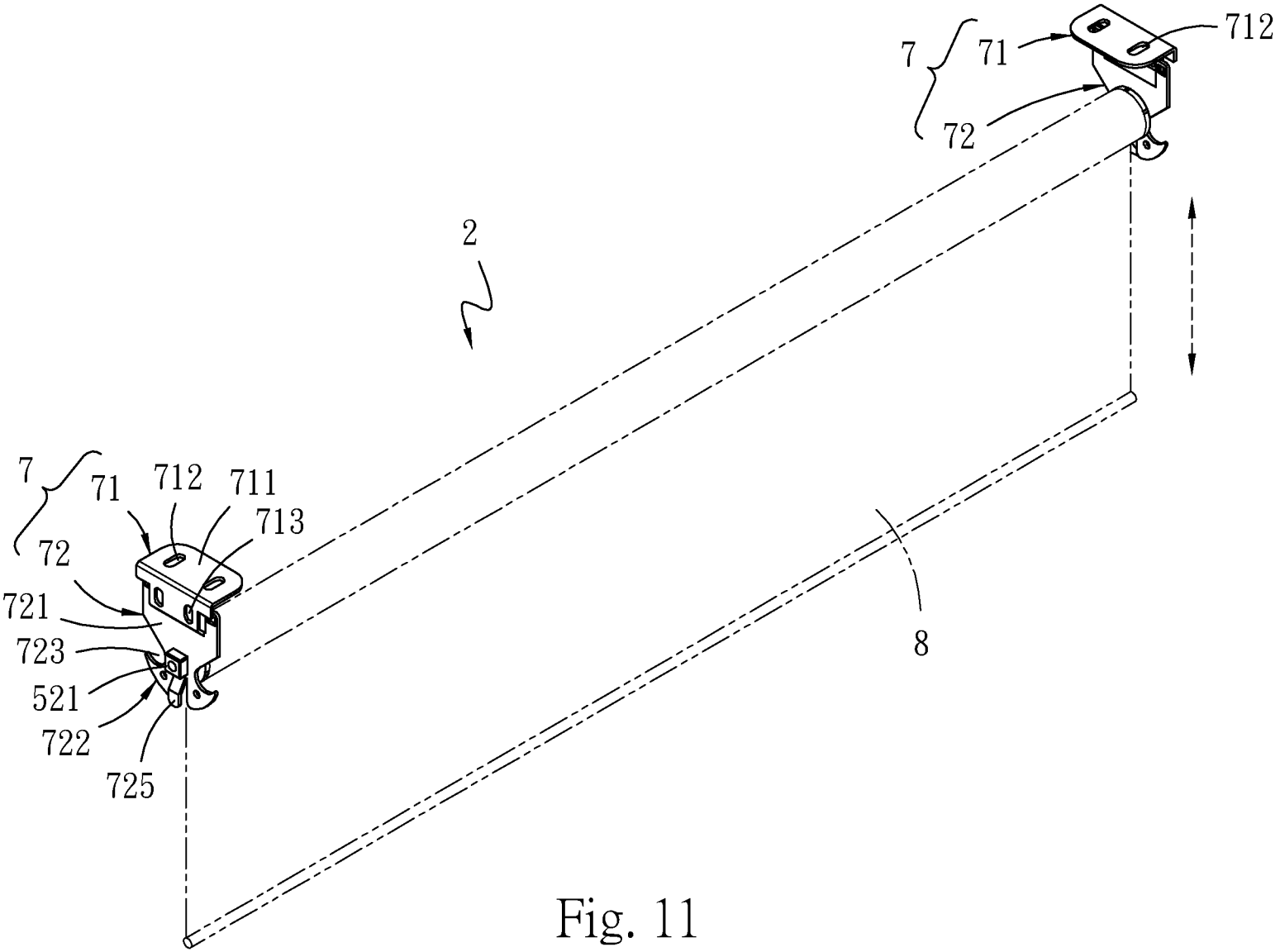
FIG. 11 is a schematic diagram of opening and closing of a blind of the roller blind of the invention.

Please refer to FIG. 4, FIG. 5, FIG. 6, FIG. 7A, FIG. 7B, FIG. 8A and FIG. 11. The invention provides a conveniently fixed roller blind and a fixing device thereof. A roller blind 2 includes a sleeving tube 3, a shaft assembly 4 installed in one end of the sleeving tube 3, a fixing device 5 installed in another end of the sleeving tube 3 which is opposite to the shaft assembly 4, a retractable device 6 installed in the sleeving tube 3 and located between the shaft assembly 4 and the fixing device 5, two fixing brackets 7 correspondingly disposed to each other and fixed at two sides above a window, and a blind 8 capable of wrapping around an outer periphery of the sleeving tube 3 in which the retractable device 6 is installed. The two fixing brackets 7 are axially connected with the shaft assembly 4 and the fixing device 5 respectively. The shaft assembly 4 and the retractable device 6 are conventional components and will not be describe herein. The sleeving tube 3 is a hollow tube 31, and an elongated slot 32 is provided on a tube body of the sleeving tube 3 for one end of the blind 8 to be placed into and fixed.

The fixing device 5 includes a shaft housing cover 51, a press buckle 52, a spring 53, a spring damping sleeve 54, a damping ring 55, and a safety buckle shaft housing 56. The shaft housing cover 51 includes a cover flange 511 with a first opening 512, a convex connecting portion 513 extending from one side of the cover flange 511 and comprising a second opening 514 communicating with the first opening 512, at least two snapping portions 515 extending from one side of the cover flange 511 and respectively comprising an elastic snap fastener connecting to an outer periphery of the convex connecting portion 513, and a plurality of first embedding rods 517 spaced apart from each other and abutting on an abutting body 516 located on the inner periphery of the convex connecting portion 513. There are three snapping portions 515 in this embodiment. Further, first embedding grooves 518 communicating with the second opening 514 are respectively formed between the plurality of first embedding rods 517. An inner diameter of the second opening 514 is larger than an inner diameter of the first opening 512.

The press buckle 52 includes a first fixing column 521 penetrating through the shaft housing cover 51, a protruding rod 522 extending from one end of the first fixing column 521 and comprising a third opening 523, and a plurality of second embedding rods 525 spaced apart on an outer periphery of a rear section of the protruding rod 522 and respectively embedding with the first embedding grooves 518. Inside the protruding rod 522 is formed with a first chamber 524 communicating with the third opening 523. Further, a plurality of second embedding grooves 526 for embedding with the plurality of first embedding rods 517 is respectively formed between the plurality of second embedding rods 525. The first fixing column 521 is a square column in this embodiment, and an outer periphery of a front section of the protruding rod 522 is provided with a first perforation 527. The first fixing column 521 and the front section of the protruding rod 522 penetrate from the second opening 514 to reach the first opening 512, and the plurality of second embedding rods 525 embed with the first embedding grooves 518 and respectively abut and fix on the abutting body 516 on the inner periphery of the convex connecting portion 513 to prevent the press buckle 52 from coming out of an outer end of the first opening 512.

One end 531 of the spring 53 is inserted in the first chamber 524 and disposed at a top end of the first chamber 524, and the spring 53 expands and contracts inside the first chamber 524.

The spring damping sleeve 54 includes an outer sleeve 541 assembled on an end of the press buckle 52 and comprising a fourth opening 542, an convex abutting portion 543 extending from an end 5411 of the outer sleeve 541, and a second fixing column 544 adjacent to the convex abutting portion 543 and extending toward an opposite direction from the end 5411 of the outer sleeve 541. Inside the outer sleeve 541 is provided with a second chamber 545 communicating with the fourth opening 542, and an end of the second chamber 545 is provided with a protruding portion 5451 and a ring groove 5452 located on an outer periphery of the protruding portion 5451, so that another end 532 of the spring 53 is accommodated in the ring groove 5452 and fixed on the outer periphery of the protruding portion 5451. The spring 53 is located inside the first chamber 524 and the second chamber 545, and the press buckle 52 is moved back and forth inside the second chamber 545 by the spring 53. A plurality of third embedding rods 546 is disposed on an inner periphery of the second chamber 545 at intervals for embedding with the plurality of second embedding grooves 526, and a plurality of third embedding grooves 547 is respectively formed between the plurality of third embedding rods 546 for embedding with the plurality of second embedding rods 525. The second fixing column 544 is provided with a second perforation 548 for a fixing member (not shown in the figures) to insert into. The damping ring 55 is fixed on an outer periphery of the convex abutting portion 543 and abuts on the end 5411 of the outer sleeve 541, and the damping ring 55 forms a seal with an inner bottom end of the safety buckle shaft housing 56 so as to control rotational resistance of the blind 8 and reduce the noise generated by rotational friction of the blind 8.

The safety buckle shaft housing 56 includes a convex stopper 561 assembled on one end of the spring damping sleeve 54 and comprising a fifth opening 562, and an outer shaft sleeve 563 extending from one end of the convex stopper 561, wherein an outer diameter of the outer shaft sleeve 563 is smaller than an outer diameter of the convex stopper 561. The convex stopper 561 is formed with a third chamber 564 from the fifth opening 562 and sleeving with the cover flange 511, a first abutting portion 565 formed from a bottom end of the third chamber 564 for the cover flange 511 to abut, and a plurality of snapping grooves 5651 arranged at intervals and formed on the first abutting portion 565 to engage with the snapping portions 515. In an embodiment, three snapping grooves 5651 are disposed to match with the snapping portions 515. The outer shaft sleeve 563 comprises a fourth chamber 566 formed from the first abutting portion 565, a second abutting portion 567 formed from an end of the fourth chamber 566, and a sixth opening 568 formed from an end of the second abutting portion 567. An inner diameter of the fourth chamber 566 is smaller than an inner diameter of the third chamber 564, and an inner diameter of the second abutting portion 567 is smaller than an the inner diameter of the fourth chamber 566, and an inner diameter of the sixth opening 568 is smaller than the inner diameter of the second abutting portion 567. The fourth chamber 566 communicates with the fifth opening 562, so that the convex connecting portion 513 is placed in the fourth chamber 566 to allow the snapping portions 515 and the snapping grooves 5651 being engaged with each other, and to allow the cover flange 511 being embedded in the third chamber 564 and abutting against the first abutting portion 565. The damping ring 55 abuts between the second abutting portion 567 and the end 5411 of the outer sleeve 541 to form a tight state. The sixth opening 568 is provided for the convex abutting portion 543 and the second fixing column 544 to pass through, and the sixth opening 568 communicates with the fourth chamber 566 and the fifth opening 562.

The fixing device 5 further includes a rigid safety pin 57, and the safety pin 57 includes an elastic portion 571 that is retracted and inserted into the first perforation 527 and then resiled, a retractable portion 572 that is elastic and is bent from a top end of the elastic portion 571 and positioned, and a fixing ring 573 located at another end of the elastic portion 571. The elastic portion 571 locks the press buckle 52 in the second chamber 545 to prevent the press buckle 52 from moving back and forth or falling off while being pressed by a user's hand. When the elastic portion 571 is pulled outward from the first perforation 527, the press buckle 52 is displaced back and forth inside the second chamber 545. The retractable portion 572 is bent in a triangular shape and comprising an end 5721 capable of retractably inserting into a hollow portion at the top end of the elastic portion 571 to be positioned. A width between a top and a bottom of the triangular shape of the retractable portion 572 is larger than an outer diameter of the elastic portion 571 to prevent the retractable portion 572 from detaching during operation. The fixing ring 573 is provided for a pull ring 574 to pass through and to be fixed, and the pull ring 574 makes it convenient for the user's hand to hold and apply force, so as to increase the operation performance. In addition, the retractable portion 572 and fixing ring 573 of the safety pin 57 are folded by a single wire to prevent injury of people or scratches on objects. The safety pin 57 has features of lightweight, safe and low-cost, smaller and cheaper than general safety pins, and has a considerable difference in strength from general safety spring buckles.

Figure 8B:
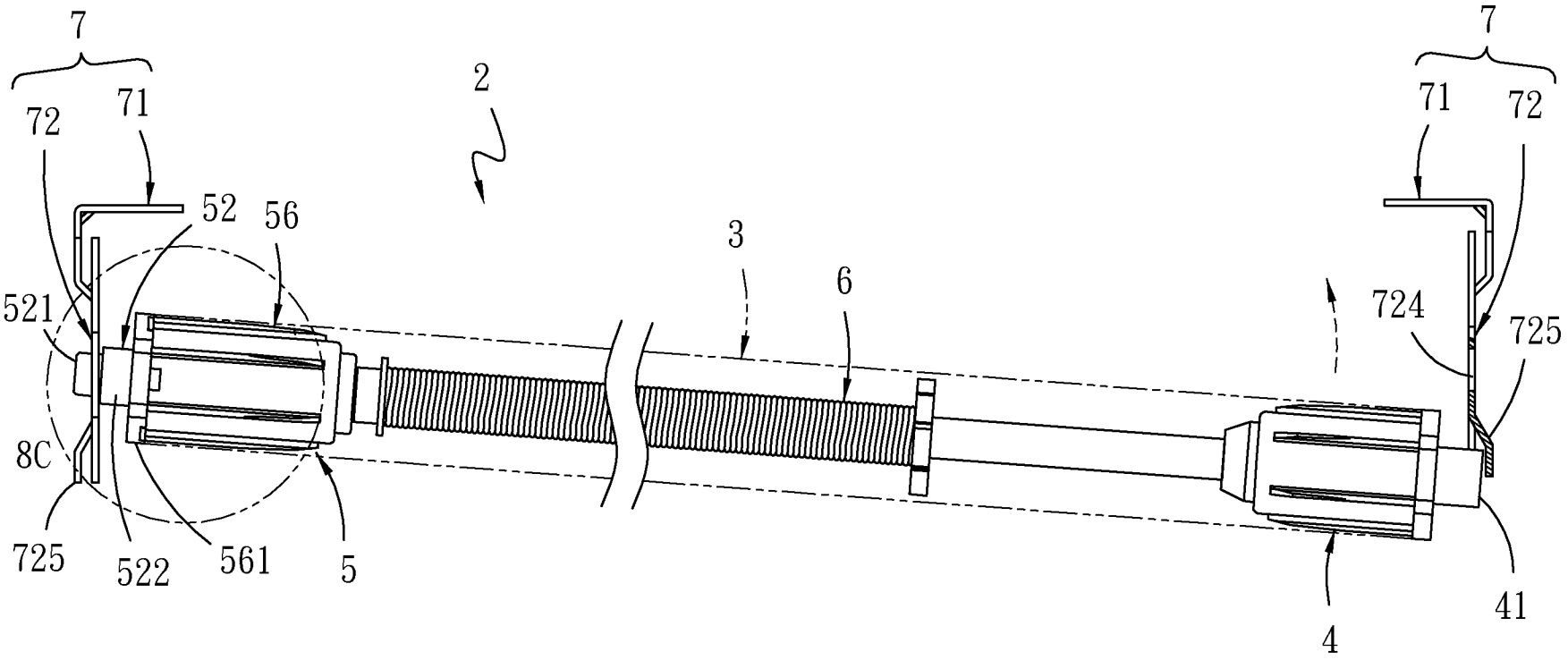
FIG. 8B is a schematic diagram of pressing a press buckle of the fixing device of FIG. 8A to retract inward and assembling a shaft assembly.
Figure 8C:
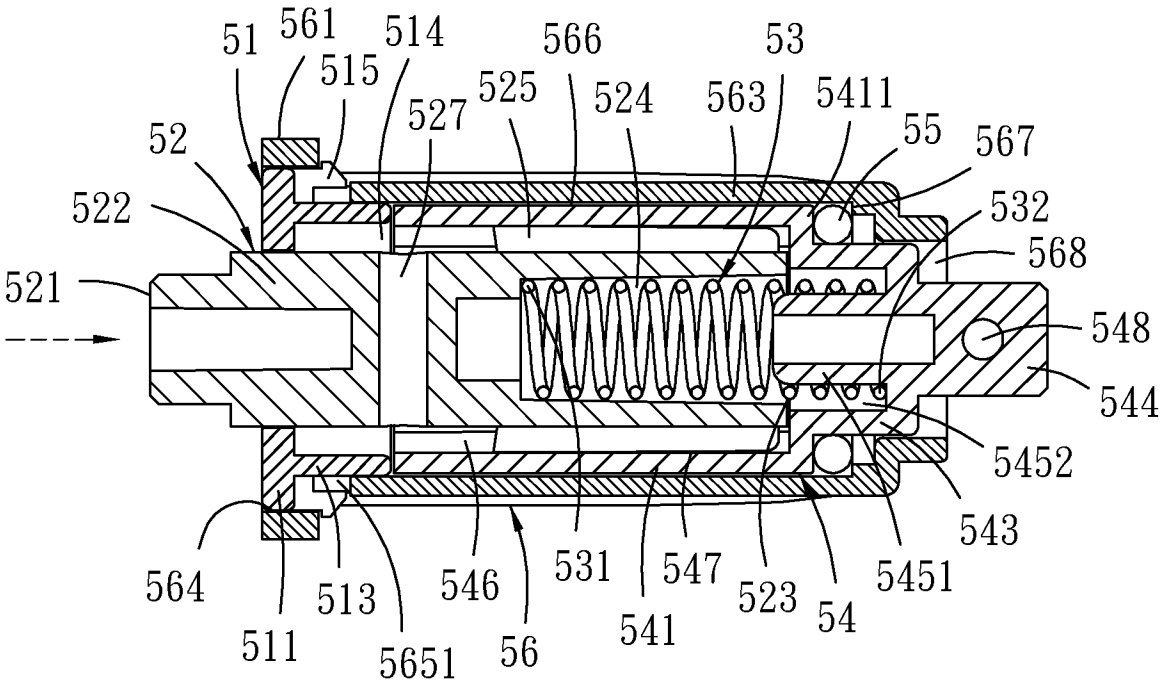
FIG. 8C is an enlarged cross-sectional view of the press buckle of FIG. 8B at position 8C retracting inward.
Figure 9A:
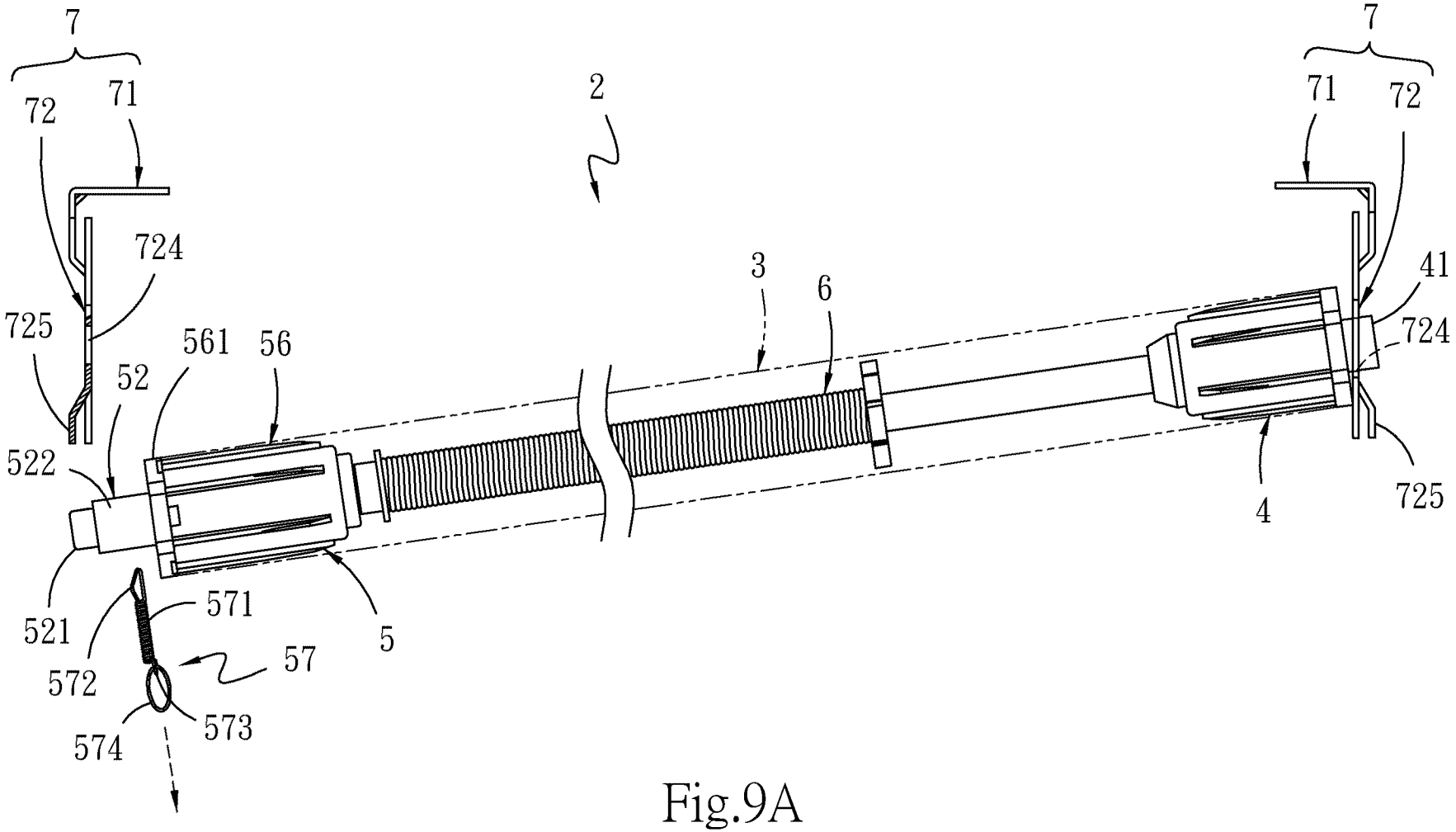
FIG. 9A is a schematic diagram of FIG. 4 firstly disposing the shaft assembly and moving the safety pin outward.
Figure 9B:
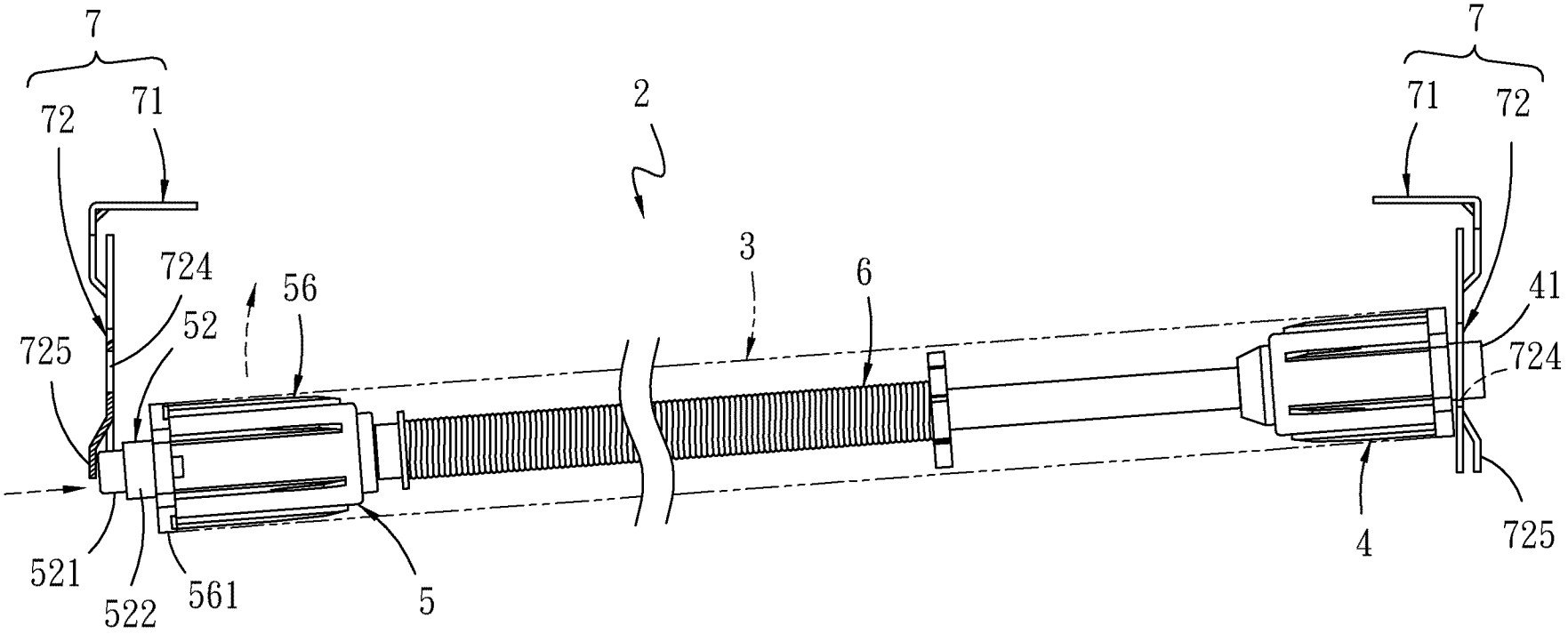
FIG. 9B is a schematic diagram of pressing the press buckle of the fixing device of FIG. 9A to retract inward and assembling the fixing device.
Figure 10:
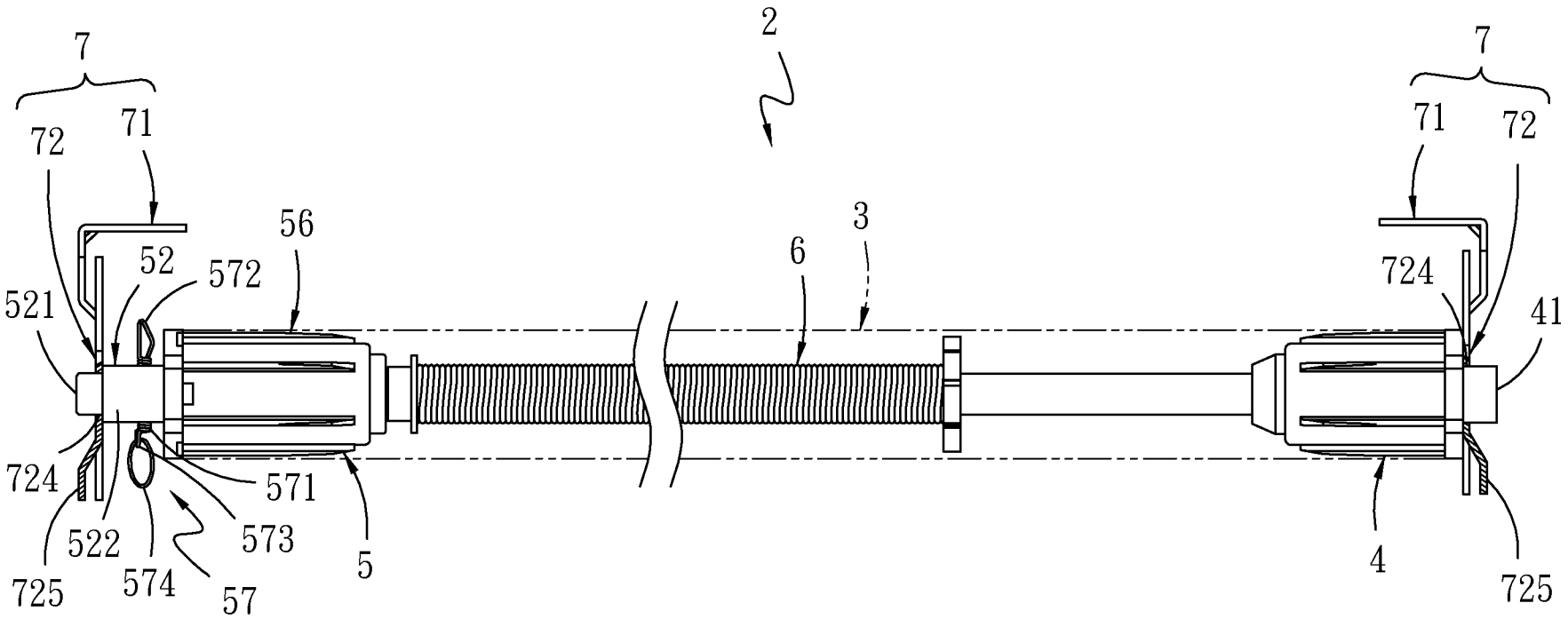
FIG. 10 is a front view of assembling configuration of the roller blind of the invention.

Please refer to FIG. 4, FIG. 5, FIG. 6, FIG. 8A, FIG. 8B, FIG. 8C, FIG. 9A, FIG. 9B, and FIG. 10. The two fixing brackets 7 respectively include a fixing body 71 installed at a side above the window, and a vertical body 72 connected to a lower portion of the fixing body 71. In each of the two fixing brackets 7, the fixing body 71 is provided with a perpendicular member 711 which comprises a plurality of fixing holes 712 on a horizontal portion thereof and a plurality of fixing holes 713 on a longitudinal portion thereof. The perpendicular member 711 is bent inwardly at a bottom end of the longitudinal portion. The vertical body 72 is provided with a connecting portion 721 connected to the bottom end of the longitudinal portion of the perpendicular member 711, and a guiding portion 722 extending downward from a bottom of the connecting portion 721. The guiding portion 722 is recessed with two grooves 723 on both sides near a bottom respectively, so that the roller blind 2 can be temporarily placed before being unlocked during installation. The guiding portion 722 is provided with a through hole 724 between the two grooves 723. The two through holes 724 of the two fixing brackets 7 are respectively provided for the first fixing column 521 and a third fixing column 41 of the shaft assembly 4 to pass through and to be positioned. The third fixing column 41 is a square column and is disposed at one end of the shaft assembly 4. The two through holes 724 are formed as square holes to match with the shapes of the first fixing column 521 and the third fixing column 41. Further, each of the two guiding portions 722 of the two fixing brackets 7 is provided with a guiding groove 725 bent outwardly at the bottom thereof, so that the first fixing column 521 and the third fixing column 41 are respectively guided from the two guiding grooves 725 into the two through holes 724 for positioning.

Please refer to FIG. 4, FIG. 5, FIG. 6, FIG. 7A, FIG. 7B and FIG. 11. When installing the roller blind 2 on a window, the two fixing brackets 7 are respectively nailed at the left and right ends first, and the spring 53 located inside the spring damping sleeve 54 is deformation by pressing the press buckle 52 to expand or contract, so as to assemble the fixing device 5. In the invention, the roller blind 2 is assembled by the following two assembly methods. The first method is as shown in FIG. 7A, FIG. 7B, FIG. 8A, FIG. 8B, FIG. 8C, FIG. 10, and FIG. 11. the first fixing column 521 at the left end of the sleeving tube 3 is installed with the fixing bracket 7 nailed at the left end first, and the first fixing column 521 is guided by the guiding groove 725 and positioned in the through hole 724 of the fixing bracket 7 nailed at the left end. Then, the safety pin 57 is pulled outward from the first perforation 527, and a width of the triangle shape of the retractable portion 572 is reduced through the first perforation 527, so as to pull out the safety pin 57 entirely and the press buckle 52 is unlocked. Then, the third fixing column 41 at the right end of the sleeving tube 3 is installed with the fixing bracket 7 nailed at the right end, and the third fixing column 41 is guided by the guiding groove 725 and positioned in the through hole 724 of the fixing bracket 7 nailed at the right end. The first fixing column 521 is pressed simultaneously to compress the spring 53 installed in the first chamber 524 and the second chamber 545, and to force the press buckle 52 to move toward the convex abutting portion 543 in the second chamber 545, so that the third fixing column 41 is positioned in the through hole 724. After that, the first fixing column 521 which is pressed is released, and the first fixing column 521 gradually returns to its original shape by an elastic force of the compressed spring 53 and gradually forces the press buckle 52 to move toward an opposite direction of the convex abutting portion 543 and to gradually move to the original position. Thus, the plurality of second embedding rods 525 respectively abuts and fixes on the abutting body 516 to prevent the press buckle 52 from coming out of an outer side of the first opening 512. Finally, the safety pin 57 is inserted into the first perforation 527 and the press buckle 52 is locked. Therefore, the blind 8 can be opened or closed. The second method is as shown in FIG. 7A, FIG. 7B, FIG. 8C, FIG. 9, FIG. 10, and FIG. 11. The third fixing column 41 at the right end of the sleeving tube 3 is installed with the fixing bracket 7 nailed at the right end first, and the third fixing column 41 is guided by the guiding groove 725 and positioned in the through hole 724 of the fixing bracket 7 nailed at the right end. Then, the safety pin 57 is pulled outward from the first perforation 527, and a width of the triangle shape of the retractable portion 572 is reduced through the first perforation 527, so as to pull out the safety pin 57 entirely and unlock the press buckle 52. Then, the first fixing column 521 at the left end of the sleeving tube 3 is installed with the fixing bracket 7 nailed at the left end, and the first fixing column 521 is guided by the guiding groove 725 and positioned in the through hole 724 of the fixing bracket 7 nailed at the left end. The first fixing column 521 is pressed simultaneously to compress the spring 53 installed in the first chamber 524 and the second chamber 545, and to force the press buckle 52 to move toward the convex abutting portion 543 in the second chamber 545, so that the first fixing column 521 is positioned in the through hole 724. After that, the first fixing column 521 which is pressed is released, and the first fixing column 521 gradually returns to its original shape by an elastic force of the compressed spring 53 and gradually forces the press buckle 52 to move toward an opposite direction of the convex abutting portion 543 and to gradually move to the original position. Thus, the plurality of second embedding rods 525 abuts and fixes on the abutting body 516 to prevent the press buckle 52 from coming out of an outer side of the first opening 512. Finally, the safety pin 57 is inserted into the first perforation 527 and the press buckle 52 is locked. Therefore, the roller blind 2 can be assembled and fixed by the fixing brackets 7 at the left end and the right end, and the blind 8 can be opened or closed.

What is claimed is:

1. A conveniently fixed roller blind comprising:

a sleeving tube;

a shaft assembly, installed in one end of the sleeving tube;

a fixing device, installed in another end of the sleeving tube which is opposite to the shaft assembly;

a retractable device, installed in the sleeving tube and located between the shaft assembly and the fixing device;

two fixing brackets, fixed at two sides above a window, and the two fixing brackets axially connected with a third fixing column of the shaft assembly and the fixing device respectively, wherein each of the two fixing brackets includes a fixing body installed at one of the sides above the window, and a vertical body connected to a lower portion of the fixing body, and the vertical body comprises a through hole provided for the third fixing column and one end of the fixing device to pass through and to be positioned; and a blind, wrapped around an outer periphery of the sleeving tube in which the retractable device is installed;

wherein the fixing device includes:

a shaft housing cover, including a cover flange with a first opening, a convex connecting portion extending from one side of the cover flange and comprising a second opening communicating with the first opening, at least two snapping portions extending from one side of the cover flange and respectively comprising an elastic snap fastener connecting to an outer periphery of the convex connecting portion, a plurality of first embedding rods spaced apart from each other and abutting on an abutting body located on an inner periphery of the convex connecting portion, and each of the plurality of first embedding rods comprising a first embedding groove;

a press buckle, including a first fixing column penetrating through the shaft housing cover and inserted into the through hole, a protruding rod extending from one end of the first fixing column and comprising a third opening and formed with a first chamber inside, and a plurality of second embedding rods spaced apart on an outer periphery of a rear section of the protruding rod, wherein a plurality of second embedding grooves for embedding with the plurality of first embedding rods are respectively formed between the plurality of second embedding rods and abuts on the abutting body respectively;

a spring, one end of the spring inserted in the first chamber and disposed at a top end of the first chamber, and the spring expanding and contracting inside the first chamber;

a spring damping sleeve, including an outer sleeve assembled on an end of the press buckle and comprising a fourth opening and a second chamber communicating with the fourth opening, wherein an end of the second chamber is provided for accommodating another end of the spring, and a plurality of third embedding rods are disposed on an inner periphery of the second chamber at intervals for embedding with the plurality of second embedding grooves, and a plurality of third embedding grooves are respectively formed between the plurality of third embedding rods for embedding with the plurality of second embedding rods, and an convex abutting portion extends from an end of the outer sleeve, and a second fixing column is adjacent to the convex abutting portion and extends toward an opposite direction from the end of the outer sleeve;

a damping ring, fixed on an outer periphery of the convex abutting portion and abuts on the end of the outer sleeve, and the damping ring forming a seal with an inner bottom end of a safety buckle shaft housing; and the safety buckle shaft housing, including a convex stopper assembled on one end of the spring damping sleeve and comprising a fifth opening, and an outer shaft sleeve extending from one end of the convex stopper, wherein the convex stopper is formed with a third chamber from the fifth opening and sleeving with the cover flange, a first abutting portion formed from a bottom end of the third chamber for the cover flange to abut, and a plurality of snapping grooves arranged at intervals are formed on the first abutting portion engaged with the snapping portions, and wherein the outer shaft sleeve comprises a fourth chamber, a second abutting portion formed from an end of the fourth chamber, and a sixth opening extends from an end of the second abutting portion, and wherein the fourth chamber communicates with the fifth opening, and the convex connecting portion is placed in the fourth chamber to allow the snapping portions and the snapping grooves to engage with each other, and to allow the cover flange embedded in the third chamber and abutting against the first abutting portion, and the damping ring abuts between the second abutting portion and one end of the outer sleeve to form a tight state, and the sixth opening is provided for the convex abutting portion and the second fixing column to pass through, and the press buckle is moved back and forth inside the second chamber by the spring, and the press buckle is pressed to allow the conveniently fixed roller blind to be assembled and fixed by the two fixing brackets.

2. The conveniently fixed roller blind as claimed in claim 1, wherein the first embedding grooves communicate with the second opening respectively, and an inner diameter of the second opening is larger than an inner diameter of the first opening.

3. The conveniently fixed roller blind as claimed in claim 1, wherein the first fixing column is a square column, and the first fixing column and a front section of the protruding rod penetrate through the second opening to reach the first opening, and the third fixing column is a square column, and the through holes of the two fixing brackets are square holes to receive the first fixing column and the third fixing column.

4. The conveniently fixed roller blind as claimed in claim 1, wherein an end of the second chamber of the outer sleeve is provided with a protruding portion and a ring groove located on an outer periphery of the protruding portion, and another end of the spring is accommodated in the ring groove and fixed on the outer periphery of the protruding portion, and the second fixing column is provided with a second perforation for a fixing member to be inserted into.

5. The conveniently fixed roller blind as claimed in claim 1, wherein an outer diameter of the outer sleeve is smaller than an outer diameter of the convex stopper, an inner diameter of the fourth chamber is smaller than an inner diameter of the third chamber, and an inner diameter of the second abutting portion is smaller than an inner diameter of the fourth chamber.

6. The conveniently fixed roller blind as claimed in claim 1, wherein a first perforation is provided on an outer periphery of a front section of the protruding rod, and the fixing device further includes a safety pin which includes an elastic portion retracted and inserted into the first perforation and then resiled, a retractable portion which is elastic and is bent from a top end of the elastic portion, and a fixing ring located at another end of the elastic portion, and the retractable portion is bent in a triangular shape and comprises an end capable of retractably inserting into a hollow portion at the top end of the elastic portion to be positioned, and a width between a top and a bottom of the triangular shape of the retractable portion is larger than an outer diameter of the elastic portion, and the fixing ring is provided for a pull ring to pass through and to be fixed.

7. The conveniently fixed roller blind as claimed in claim 1, wherein the fixing body of each of the two fixing brackets is provided with a perpendicular member which comprises a plurality of fixing holes on a horizontal portion and a longitudinal portion thereof, and the perpendicular member is bent inwardly at a bottom end of the longitudinal portion, and the vertical body is provided with a connecting portion connected to the bottom end of the longitudinal portion of the perpendicular member, and a guiding portion extending downward from a bottom of the connecting portion, and the guiding portion is recessed with two grooves on both sides near a bottom respectively to allow the conveniently fixed roller blind to be temporarily placed, and the guiding portion is provided with the through hole between the two grooves, and the through hole is provided for the first fixing column and the third fixing column to pass through and to be positioned, and the guiding portion is provided with a guiding groove bent outwardly at the bottom thereof to allow the first fixing column and the third fixing column being guided from the guiding groove into the through hole for positioning.

8. A fixing device, comprising:

a shaft housing cover, including a cover flange with a first opening, a convex connecting portion extending from one side of the cover flange and comprising a second opening communicating with the first opening, at least two snapping portions extending from one side of the cover flange and respectively comprising an elastic snap fastener connecting to an outer periphery of the convex connecting portion, a plurality of first embedding rods spaced apart from each other and abutting on an abutting body located on an inner periphery of the convex connecting portion, and each of the plurality of first embedding rods comprising a first embedding groove;

a press buckle, including a first fixing column penetrating through the shaft housing cover, a protruding rod extending from one end of the first fixing column and comprising a third opening and formed with a first chamber inside, and a plurality of second embedding rods spaced apart on an outer periphery of a rear section of the protruding rod, wherein a plurality of second embedding grooves for embedding with the plurality of first embedding rods are respectively formed between the plurality of second embedding rods and abuts on the abutting body respectively;

a spring, one end of the spring inserted in the first chamber and disposed at a top end of the first chamber, and the spring expanding and contracting inside the first chamber;

a spring damping sleeve, including an outer sleeve assembled on an end of the press buckle and comprising a fourth opening and a second chamber communicating with the fourth opening, wherein an end of the second chamber is provided for accommodating another end of the spring, and a plurality of third embedding rods are disposed on an inner periphery of the second chamber at intervals for embedding with the plurality of second embedding grooves, and a plurality of third embedding grooves are respectively formed between the plurality of third embedding rods for embedding with the plurality of second embedding rods, and an convex abutting portion extends from an end of the outer sleeve, and a second fixing column is adjacent to the convex abutting portion and extends toward an opposite direction from the end of the outer sleeve;

a damping ring, fixed on an outer periphery of the convex abutting portion and abuts on the end of the outer sleeve, and the damping ring forming a seal with an inner bottom end of a safety buckle shaft housing; and the safety buckle shaft housing, including a convex stopper assembled on one end of the spring damping sleeve and comprising a fifth opening, and an outer shaft sleeve extending from one end of the convex stopper, wherein the convex stopper is formed with a third chamber from the fifth opening and sleeving with the cover flange, a first abutting portion formed from a bottom end of the third chamber for the cover flange to abut, and a plurality of snapping grooves arranged at intervals are formed on the first abutting portion to engage with the snapping portions, and wherein the outer shaft sleeve comprises a fourth chamber, a second abutting portion formed from an end of the fourth chamber, and a sixth opening extends from an end of the second abutting portion, and wherein the fourth chamber communicates with the fifth opening, and the convex connecting portion is placed in the fourth chamber to allow the snapping portions and the snapping grooves to engage with each other, and to allow the cover flange to be embedded in the third chamber and abutting against the first abutting portion, and the damping ring abuts between the second abutting portion and one end of the outer sleeve to form a tight state, and the sixth opening is provided for the convex abutting portion and the second fixing column to pass through.

9. The fixing device as claimed in claim 8, wherein the first embedding grooves communicates with the second opening respectively, and an inner diameter of the second opening is larger than an inner diameter of the first opening.

10. The fixing device as claimed in claim 8, wherein the first fixing column is a square column, and the first fixing column and a front section of the protruding rod penetrate through the second opening to reach the first opening.

11. The fixing device as claimed in claim 8, wherein an end of the second chamber of the outer sleeve is provided with a protruding portion and a ring groove located on an outer periphery of the protruding portion, and another end of the spring is accommodated in the ring groove and fixed on the outer periphery of the protruding portion, and the second fixing column is provided with a second perforation for a fixing member to be inserted into.

12. The fixing device as claimed in claim 8, wherein an outer diameter of the outer sleeve is smaller than an outer diameter of the convex stopper, an inner diameter of the fourth chamber is smaller than an inner diameter of the third chamber, and an inner diameter of the second abutting portion is smaller than an inner diameter of the fourth chamber.

13. The fixing device as claimed in claim 8, wherein a first perforation is provided on an outer periphery of a front section of the protruding rod, and the fixing device further includes a safety pin which includes an elastic portion retracted and inserted into the first perforation and then resiled, a retractable portion which is elastic and is bent from a top end of the elastic portion and positioned, and a fixing ring located at another end of the elastic portion, and the retractable portion is bent in a triangular shape and comprises an end capable of retractably inserting into a hollow portion at the top end of the elastic portion to be positioned, and a width between a top and a bottom of the triangular shape of the retractable portion is larger than an outer diameter of the elastic portion, and the fixing ring is provided for a pull ring to pass through and to be fixed.

* * * * *